US006571424B2

(12) United States Patent
Roschi et al.

(10) Patent No.: US 6,571,424 B2
(45) Date of Patent: Jun. 3, 2003

(54) DEVICE FOR REMOVING DUST AND RUBBISH

(75) Inventors: Ermes Roschi, Varese (IT); Riccardo Roschi, Varese (IT)

(73) Assignee: New Ermes Europe S.p.A., Albizzate (IT)

( * ) Notice: Subject to any disclaimer, the term of this patent is extended or adjusted under 35 U.S.C. 154(b) by 0 days.

(21) Appl. No.: 09/769,743

(22) Filed: Jan. 26, 2001

(65) Prior Publication Data

US 2001/0011404 A1 Aug. 9, 2001

(30) Foreign Application Priority Data

Jan. 28, 2000 (EP) ..... 00830053

(51) Int. Cl.[7] ..... A47L 9/04

(52) U.S. Cl. ..... 15/387; 15/338; 15/355; 15/419

(58) Field of Search ..... 15/328, 338, 355, 15/387, 419, 373

(56) References Cited

U.S. PATENT DOCUMENTS 2,416,418 A * 2/1947 Taylor ..... 15/373
2,627,623 A * 2/1953 Humphrey ..... 15/373
3,855,666 A * 12/1974 Erikson et al. ..... 15/372
5,008,973 A 4/1991 Wörwag ..... 15/416
5,249,333 A 10/1993 Wörwag ..... 15/387
5,293,665 A * 3/1994 Worwag ..... 15/328
5,416,948 A * 5/1995 Worwag ..... 15/387

FOREIGN PATENT DOCUMENTS

DE 41 05 012 10/1992
EP 0 315 068 5/1989

OTHER PUBLICATIONS

Patent Abstracts of Japan vol. 018, No. 367 (C–1223), Jul. 1994 & JP 06 098840 (Hitachi LTD), Apr. 1994.

* cited by examiner

*Primary Examiner*—Theresa T. Snider
(74) *Attorney, Agent, or Firm*—Nixon & Vanderhye, P.C.

(57) ABSTRACT

A device for removing dust and rubbish includes a casing provided with a suction opening, a rotating brush, a turbine operationally connected to the brush, a suction nozzle located between the brush and the turbine, and a suction pipe connected to a suction device; the brush and the turbine are rotatably supported, respectively, in a first and in a second housing; the device also includes at least a bypass duct and a first valve, the bypass duct being designed for bypassing the second housing and the turbine, the first valve being able to engage with the suction nozzle and with the bypass duct for closing the suction nozzle and opening the bypass duct.

21 Claims, 9 Drawing Sheets

DEVICE FOR REMOVING DUST AND RUBBISH

This application is based on European Patent Application No. 00830053.5 filed on Jan. 28, 2000, the content of which is incorporated hereinto by reference.

BACKGROUND

I. Field of the Invention

The present invention relates to a device for removing dust and rubbish from a surface, for example a fabric surface, such as a moquette, carpet and the like, or from a bare surface, such as a tiled, marble, wooden (parquet) and similar type of floor.

II. Related Art and Other Considerations

Conventional devices for removing dust and rubbish, provided with a turbo-brush head which may be replaced by a simple suction head, are known. In most cases the former is used to clean fabric surfaces, while the latter is used to clean bare surfaces.

Generally, the turbo-brush head includes a rotating brush provided with bristles and actuated by a turbine with radial vanes. The rotating brush and the turbine are rotatably supported in two housings inside a casing. The casing has a suction opening, inside which the rotating brush is placed, and a suction nozzle located between the rotating brush and the turbine. A suction pipe connected to a suction device communicates with the suction nozzle and the turbine housing.

When the suction device is in operation, an air flow passes through the suction opening, the nozzle and the suction pipe and strikes the vanes of the turbine, causing the latter to rotate. The turbine transmits the rotary movement to the brush via a toothed belt, and the brush, rotating, with its bristles passes over the surface to be cleaned (fabric surface, which may be padded, tapestry, furnishing, moquette, carpet and the like), removing the dust and the rubbish which are sucked up by the air flow generated by the suction device.

The simple suction head, in turn, includes its own suction opening which is placed in communication with the suction pipe connected to the suction device.

JP-06098840 discloses a vacuum cleaner having a suction air flow which is turned into a jet flow after passing through a nozzle to rotate an impeller and then it is turned into an exhaust air flow. Rotation of the impeller of the turbine rotates a rotary brush through a timing belt. A main nozzle and a bypass nozzle are positioned on a nozzle supporting plate and the cross-sectional shape of the nozzle is made into a circular form or an elliptic form. A plate shutter is engageable with the bypass nozzle to close it. The main nozzle is used for a heavy loading such as a carpet and the bypass nozzle is used for a relatively light loading such as a tatami mat or a wooden flooring.

The circular or elliptic form of the nozzle has the purpose of decreasing the sound of the air flow.

In said vacuum cleaner, the air flows coming from both the main and bypass nozzles enter the turbine housing.

The turbine and the rotary brush are always active, since the steps of opening and closing the bypass nozzle have only the aim of adjusting the air flow directed on the turbine.

Therefore, said vacuum cleaner always operates as a turbo-brush head and never can operate only as a suction head.

As far as the inventors are aware, hitherto a commercial device which is capable of operating both as a turbo-brush head and as a simple suction head has not yet been developed.

The object of the present invention is to provide a device which is capable of performing both the functions and which is easy and inexpensive to manufacture.

SUMMARY

A device for removing dust and rubbish from a surface comprises a casing provided with a suction opening, a rotating brush, and a turbine operationally connected to the brush, a suction nozzle having a predefined flow cross-section, and a suction pipe connected to a suction device. The rotating brush has a shaft rotatably supported in a first housing of the casing; the turbine has a shaft rotatably supported in a second housing of said casing. The suction nozzle is located between the rotating brush and the turbine for directing an air flow from the suction opening onto the rotating brush and then towards the turbine. The device also includes a bypass duct and a first valve, the bypass duct having a predefined flow cross-section and being designed for bypassing the second housing and the turbine, and for connecting the suction opening and the first housing with the suction pipe and the suction device. The first valve is able to engage the suction nozzle and the bypass duct for closing the suction nozzle and opening the bypass duct.

Opening of the bypass duct, together with the simultaneous closing of the suction nozzle, deactivates the turbine and the rotating brush and causes the device to operate as a suction head only. In turn, opening of the suction nozzle, together with simultaneous closing of the bypass duct, activates the turbine and the rotating brush and causes the device to operate as a turbo-brush head.

Preferably, said first valve is able to vary gradually the flow cross-section of the suction nozzle.

Advantageously, the first valve is able to vary gradually the flow cross-section of the at least a bypass duct.

In particular, the first valve is able to close gradually the flow cross-section of the suction nozzle, while the first valve gradually opens the flow cross-section of the bypass duct.

Advantageously, the first valve is connected to a manual actuating element.

Preferably, the first valve comprises a first slide valve having a first sliding shutter provided with a first opening able to be superimposed on the flow cross-section of the suction nozzle.

In an embodiment, the first sliding shutter is further provided with a second opening able to be superimposed on the flow cross-section of the bypass duct.

Preferably, the first and second opening of the first sliding shutter have a width greater than the width of the flow cross-section of the suction nozzle and, respectively, of the flow cross-section of the bypass duct.

Advantageously, the device also includes an auxiliary opening which connects the first housing to the external environment and a second valve able to engage with the auxiliary opening for opening it when the turbine undergoes a drop in power owing to obstruction of the suction opening, for example by a moquette or a carpet.

Preferably, the second valve comprises a second slide valve having a second sliding shutter provided with a third opening designed to be superimposed on the auxiliary opening.

Advantageously, the first and second sliding shutter are operationally connected to a slider actuator.

Typically, the shaft of the rotating brush is also movably supported in the first housing and is operationally connected to actuating means capable of raising it and keeping it raised so as to move said rotating brush away from the surface to be cleaned.

Preferably, the actuating means includes two levers which rotatably support the shaft of the rotating brush. The two levers are pivotably mounted in the first housing.

Advantageously, the actuating means also includes a projecting element integral with the levers, the first sliding shutter being provided with a ramp and a surface which engage with the projecting element, raising it and causing it to rotate integrally with the levers for raising the rotating brush and keeping it raised.

Preferably, the first opening of the first sliding shutter is able to be superimposed on the the flow cross-section of said suction nozzle and/or on the flow cross-section of the bypass duct.

Typically, the first opening of the first shutter has a width greater than the width of the flow cross-section of the suction nozzle and substantially equal to the width of the flow cross-section of the bypass duct.

In an embodiment, the bypass duct is placed under the second housing.

In another embodiment, a first bypass duct and a second bypass duct are placed at the sides of the second housing.

Preferably, the first sliding shutter is provided with a lateral portion able to be superimposed on the flow cross-section of the second bypass duct, while the first opening is able to be superimposed on the flow cross-section of the suction nozzle and/or on the flow cross-section of the first bypass duct.

As already indicated, the device according to the invention offers the advantage that it may be used both as a turbo-brush head for cleaning a moquette, a carpet and the like, and as a simple suction head for cleaning a bare surface.

In order to vary the operating mode of the device from a turbo-brush head to a simple suction head, it is simply required to actuate manually the first valve so that it closes the nozzle which conveys the sucked-in air flow towards the turbine and, at the same time, open the turbine bypass duct. As a result, the turbine is deactivated and ceases to actuate the rotating brush, while the air which enters via the suction opening flows directly into the suction pipe connected to the suction device. When the operating mode as a simple suction head is selected, it is also possible to raise the rotating brush from the surface to be cleaned so that it does not hinder in any way suction of the dust and rubbish.

In addition, when the operating mode as a turbo-brush head is selected and the rotating brush encounters a strong resistance and tends to stop rotating, it is possible to activate an auxiliary opening which allows the entry of an additional air flow directed towards the turbine which thus starts to rotate again and reactivates the rotating brush.

The device is particularly efficient because the exclusion of the turbine from the path of the air which flows from the suction opening to the suction device does not produce that dispersion of energy which occurs when the sucked air flow interacts with the turbine.

BRIEF DESCRIPTION OF THE DRAWINGS

Further characteristic features and advantages of the invention will now be described with reference to embodiments illustrated by way of a non-limiting example in the accompanying figures in which.

DETAILED DESCRIPTION

Figure 1:
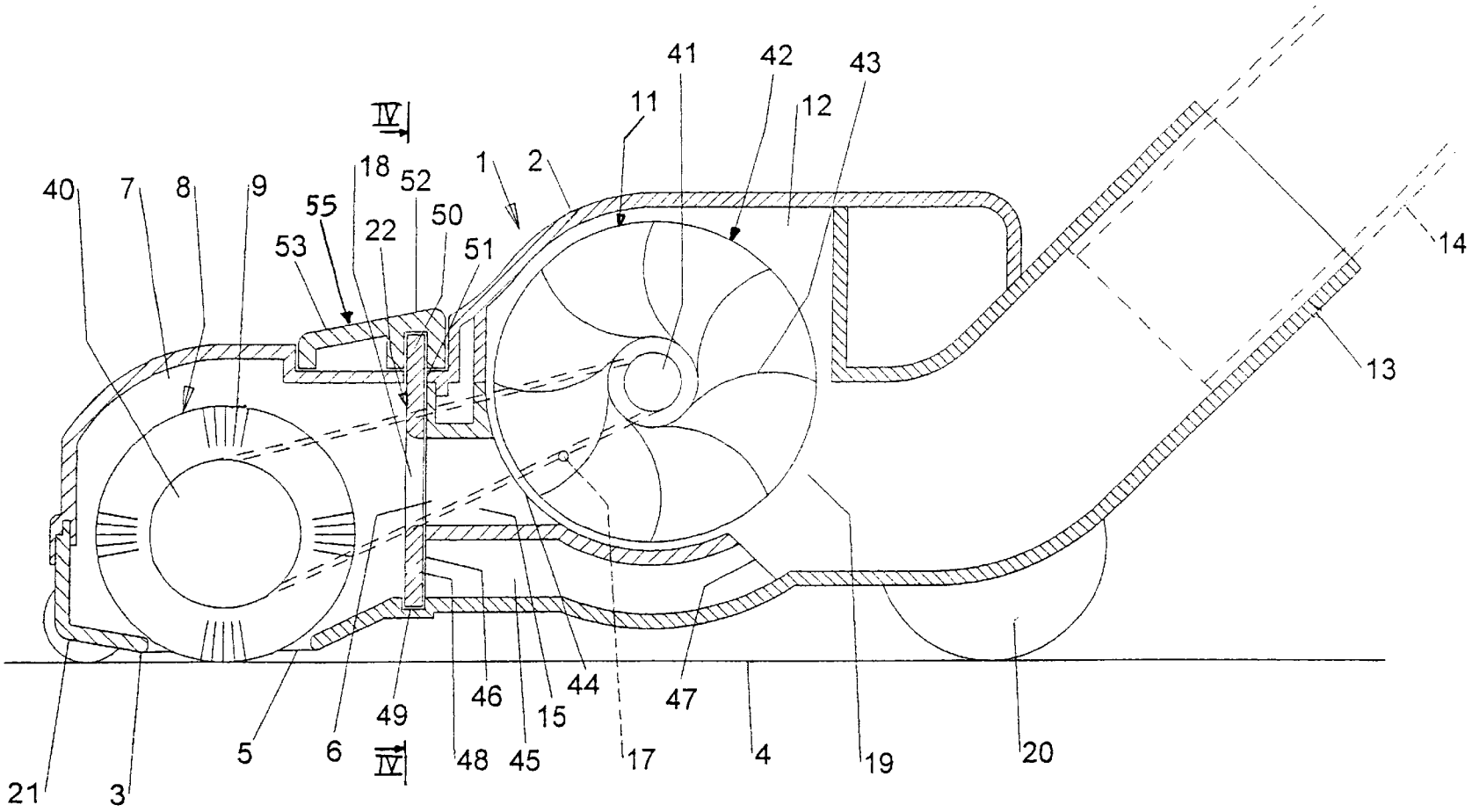
FIG. 1 is a longitudinally sectioned partial view of a device for removing dust and rubbish provided in accordance with the invention.

FIG. 1 shows a device 1 having a casing 2 provided with wheels 21 and 20. The device 1 includes a rotating brush 8 provided with bristles 9. The rotating brush 8 has a shaft 40 rotatably supported in a housing 7 of the casing 2. The brush 8 is rotated, in an anti-clockwise direction, by a turbine 11 via a toothed belt 17 and toothed pulleys, not shown. The turbine 11 has a shaft 41 and a rotor 42 provided with radial vanes 43. The shaft 41 of the turbine 11 is rotatably supported in a housing 12 in the casing 2. A suction pipe 14, which is fixed to a union 13 of the casing 2, is connected to a suction device not shown, in that it is known to the person skilled in the art. The union 13 also communicates with the housing 12 of the turbine 11 via an opening 19.

The casing 2 is provided with a suction opening 5 inside which the rotating brush 8 is arranged and has a sliding base 3 which makes contact with a surface to be cleaned 4. A suction nozzle 15 having a predefined flow cross-section, is located between the housing 7 of the rotating brush 8 and the housing 12 of the turbine 11. The nozzle 15 has an inlet port 6 communicating with the housing 7 of the rotating brush 8 and an outlet port 44 which emerges in the vicinity of the bottom vanes 43 of the turbine 11.

A duct 45 for bypassing the housing 12 of the turbine 11 is placed in the lower zone of the casing 2, under the housing 12. The bypass duct 45 has a predefined flow cross-section and has an inlet port 46 communicating with the housing 7 of the rotating brush 8 and an outlet port 47 communicating with the union 13 and the suction pipe 14. Thus, the bypass duct 45 directly connects the housing 7 of the rotating brush 8 with the union 13 and the suction pipe 14.

Figure 2:
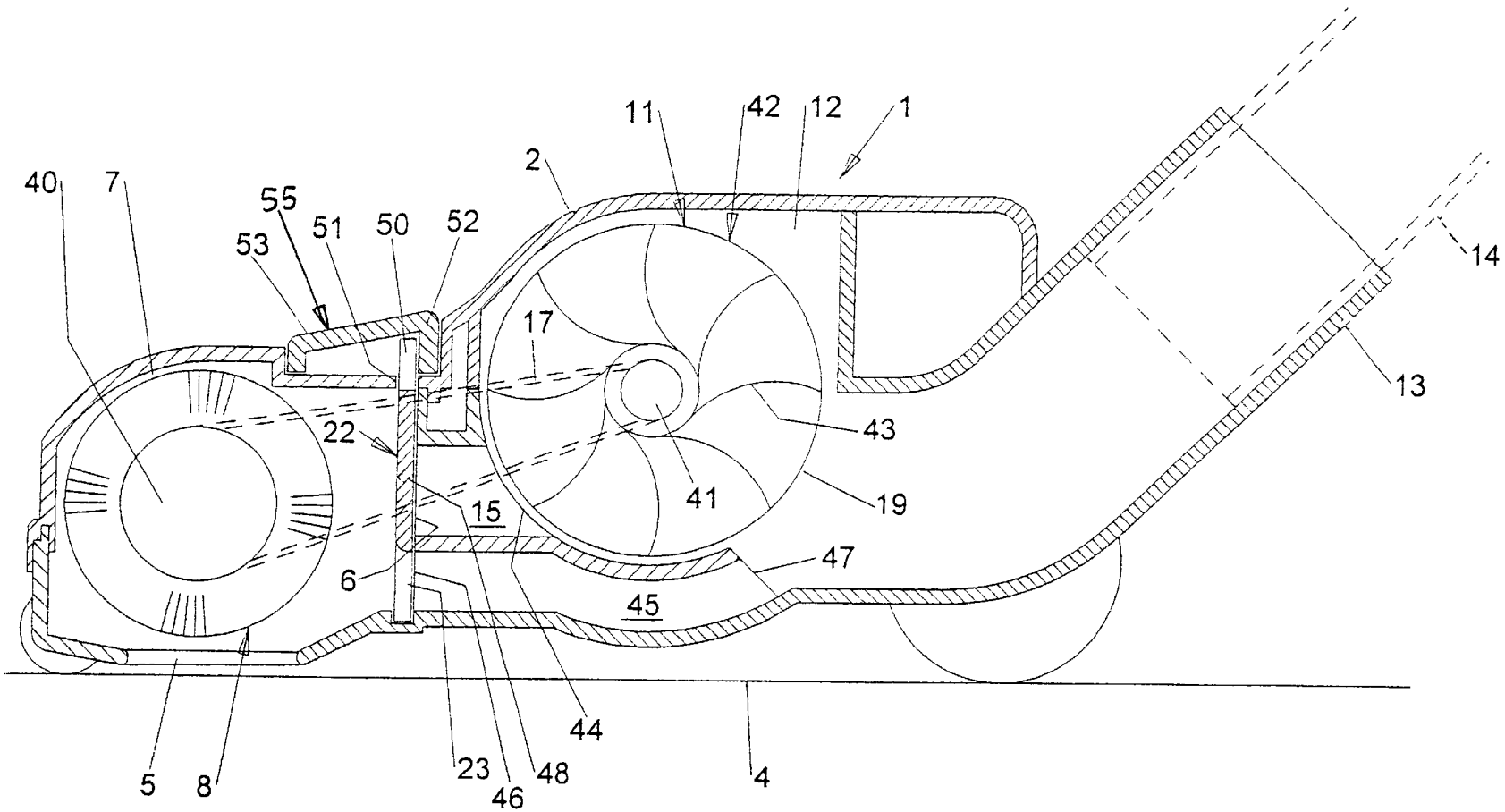
FIGS. 2 and 3 show the device of FIG. 1 in two different operating conditions.
Figure 4:
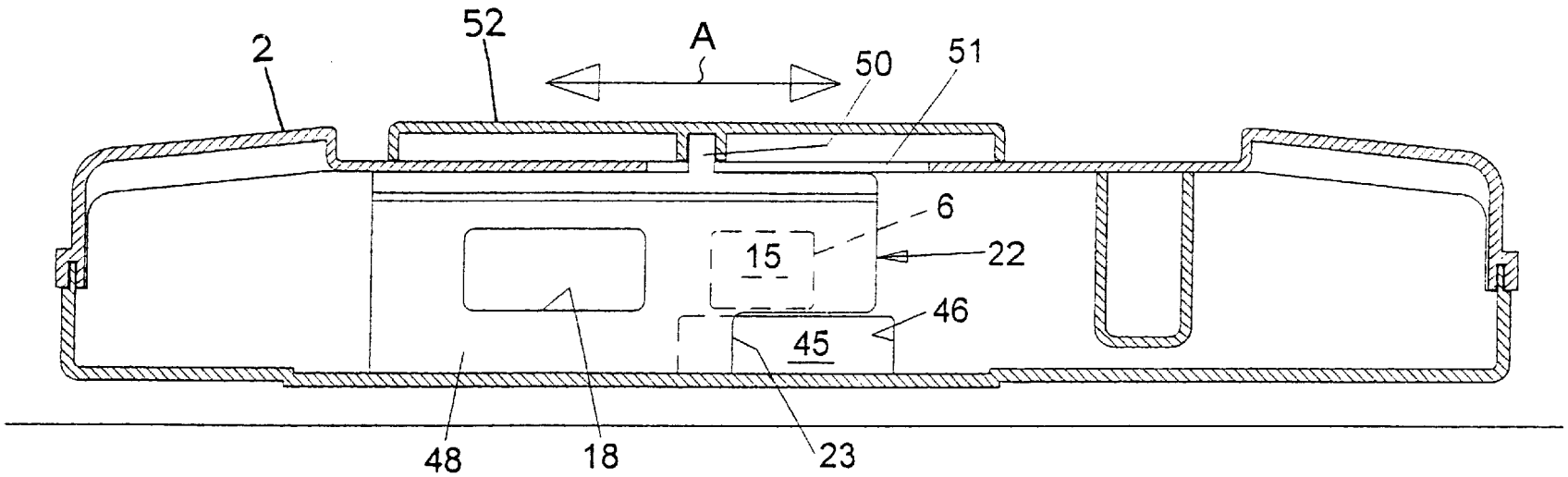
FIG. 4 shows a cross-sectional view along the plane IV—IV of FIG. 1.

A slide valve 22 has a plate-like shutter 48 which engages with the suction nozzle 15 and the bypass duct 45. The shutter 48 is mounted inside a guide channel 49 and is slidable in a transverse direction. The sliding shutter 48 has two openings 18 and 23 (FIGS. 2 and 4). The opening 18 is designed to be superimposed on the inlet port 6 of the suction nozzle 15 and to connect the housing 7 of the brush 8 to the nozzle 15. The opening 23 is designed to be superimposed on the inlet port 46 of the bypass duct 45 and to connect the housing 7 of the brush 8 to the bypass duct 45. The sliding shutter 48 is provided with a tongue 50 which emerges from a transverse slot 51 in the casing 2 and is fixed to a slider 52 which can be actuated manually by the person using the device 1.

Figure 5:
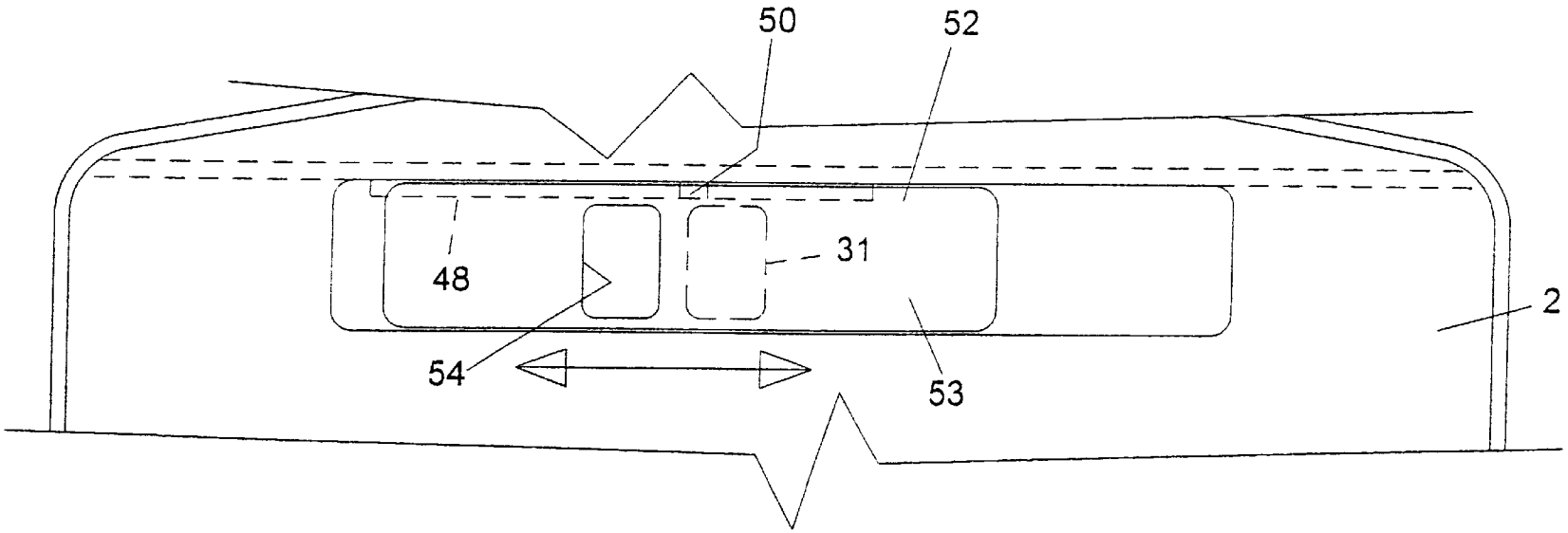
FIG. 5 shows a partial plan view of the device of FIG. 1.

The slider 52 is integral with a slide valve 55 provided with a sliding shutter 53 which engages with an auxiliary opening 31 in the casing 2. The shutter 53 has an opening 54 (FIGS. 3 and 5) which is designed to be superimposed on the auxiliary opening 31 and connect the housing 7 of the rotating brush 8 to the external environment.

Figure 6:
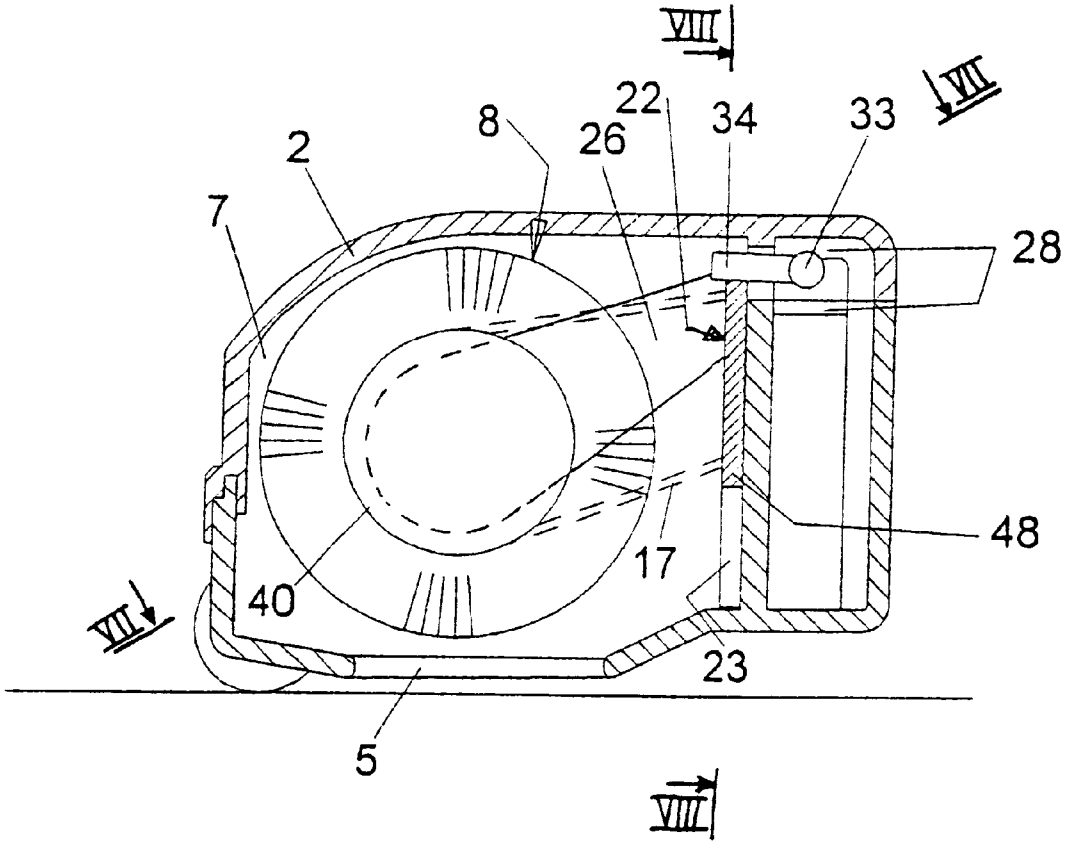
FIG. 6 shows a longitudinally sectioned partial view of another operating condition of the device of FIG. 1.
Figure 8:
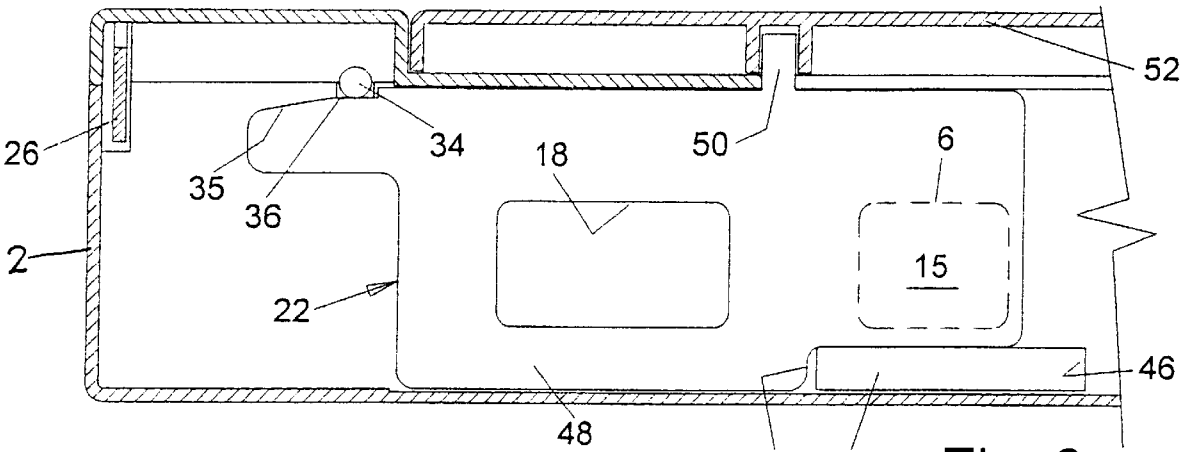
FIG. 8 shows a partial view sectioned along the plane VIII—VIII of FIG. 6.
Figure 7:
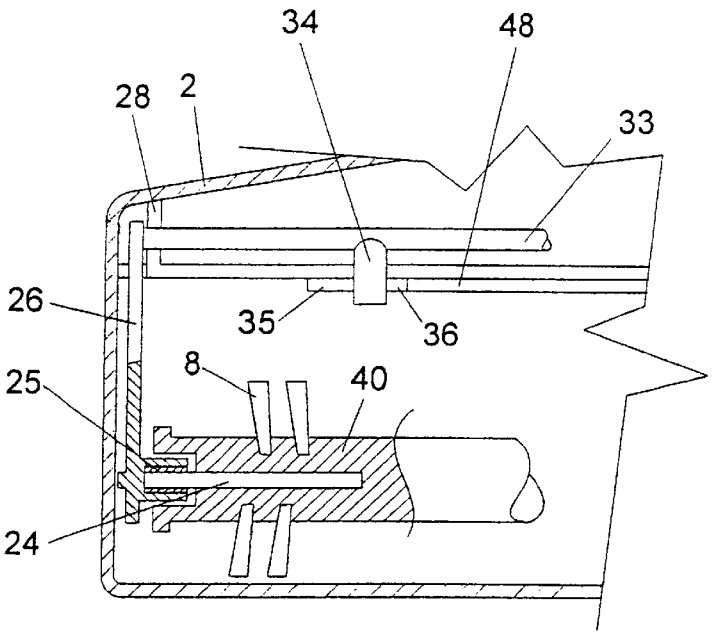
FIG. 7 shows a partial view sectioned along the plane VII—VII of FIG. 6.

As shown in FIGS. 6, 7 and 8, the shaft 40 of the rotating brush 8 is provided with two end pins 24 and bushings 25 (only one of which is shown in FIG. 7) by means of which it is rotatably supported on the outer ends of two levers 26. The levers 26 are pivotably mounted, at their inner ends, in seats 28 in the housing 7 by means of a rod 33 which renders them integral. The rod 33 is provided with a projecting element 34, for example a cam, with which a ramp 35 and a surface 36 of the sliding shutter 48 of the slide valve 22 engage, as will be illustrated further below.

FIG. 1 shows the configuration of the device 1 when it is used as a turbo-brush head for cleaning fabric surfaces, such as moquettes, carpets and the like. In this condition, an operator using the device 1 actuates the slider 52 (arrow A in FIG. 4) and adjusts the sliding shutter 48 of the slide valve 22 in a position where its opening 18 is superimposed on the inlet port 6 of the suction nozzle 15 and the suction nozzle 15 is completely open. In this position, the shutter 48 closes the inlet port 46 of the bypass duct 45.

When the suction device is switched on, an air flow passes through the opening 5, the housing 7, the suction nozzle 15, the housing 12 of the turbine 11, the union 13 and the suction pipe 14. The air flow discharged from the suction nozzle 15 strikes the vanes 43 of the turbine 11 and causes the latter to rotate. The turbine 11, in turn, causes rotation of the brush 8 via the belt 17. Then the air flow emerges from the housing 12, through the opening 19, and, via the union 13 and the pipe 14, reaches the suction device. The air flow removes the dust and the rubbish raised by the action of the bristles 9 of the rotating brush 8 passing over the surface to be cleaned.

The bristles 9 of the rotating brush 8 project from the suction opening 5 and, with their rotary movement, raise the dust and rubbish present on the surface to be cleaned, facilitating suction thereof.

A further advantage of the present invention is that, when the operator wishes to cause operation of the rotating brush 8 at a speed of rotation lower than the maximum speed, for example in order to clean valuable or delicate fabrics, he/she actuates the shutter 48 of the slide valve 22 by means of the slider 52 and displaces it in a position where the opening 18 is partly superimposed on the inlet port 6 of the suction nozzle 15 and the opening 23 is partly superimposed on the inlet port 46 of the bypass duct 45, depending on the desired reduction in speed. In this way, the flow cross-section of the nozzle 15 is reduced and the air flow which strikes the turbine 11 is proportionally reduced. The remaining part of the air flow, instead, is conveyed to the suction device via the bypass duct 45. Thus, the turbine 11 operates at a speed of rotation less than the maximum speed and the brush 8 rotates at a predefined lower speed.

In this operating condition, the reduction in the speed of rotation of the turbine is achieved without reducing the flowrate of the air which sucks the dust and rubbish from the surface to be cleaned.

FIG. 2 shows the configuration of the device I when it operates only as a suction head. In this case, the operator using the device I actuates the slider 52 and adjusts the sliding shutter 48 of the slide valve 22 in a position where the opening 18 is displaced from the inlet port 6 of the suction nozzle 15 and the opening 23 is superimposed on the inlet port 46 of the bypass duct 45. Thus, the suction nozzle 15 is closed and the turbine 11 and the rotating brush 8 are deactivated, while the bypass duct 45 is completely open. The air flow which removes the dust and rubbish from the surface to be cleaned is sucked via the opening 5, pass through the housing 7 and is directly conveyed by means of the bypass duct 45 to the union 13 and the suction pipe 14.

The rotating brush 8 is moved away from the surface 4, as will be illustrated further below.

Figure 3:
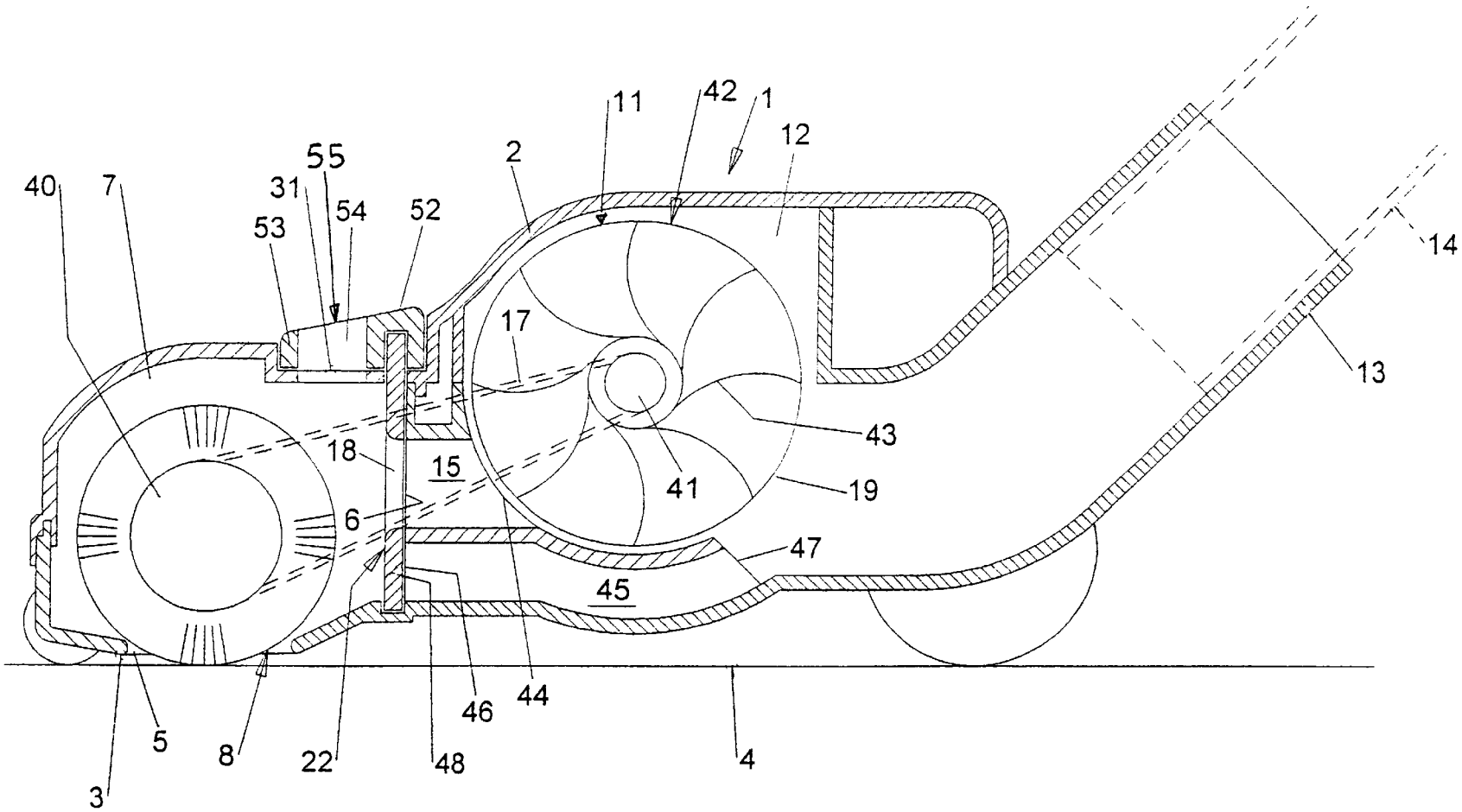

FIG. 3 shows the configuration of the device 1 when, during cleaning of surfaces 4 lined with fabric, the rotating brush 8 tends to stop rotating because the fabric to be cleaned is sucked up against the suction opening 5 and obstructs it.

In this case, the operator, by means of the slider 52, displaces the shutter 53 and causes the opening 54 to superimpose on the auxiliary opening 31 connecting the housing 7 to the external environment. Concurrently, the sliding shutter 48 keeps the inlet port 6 of the suction nozzle 15 open. Via the opening 31 and the suction nozzle 15, a secondary air flow is produced which reaches the turbine 11 and causes it to start operating again.

FIGS. 6 to 8 show the configuration of the device 1 when the rotating brush 8 is raised.

When the device 1 operates as a suction head only, the sliding shutter 48 is actuated so as to intercept the suction nozzle 15 and leave the bypass 45 open (FIG. 8). While the shutter 48 slides towards the left in the FIG. 8, its ramp 35 comes into contact with the projecting element 34 and raises it, causing it to rotate integrally with the rod 33. The projecting element 34 and the rod 33, in turn, rotate the levers 26 which raise the rotating brush 8 and cause it to move away from the suction opening 5. When the projecting element 34 reaches the surface 36, the levers 26 are locked and keep the rotating brush 8 in the completely raised position.

Therefore, changing the position of the shutter 48 of the slide valve 22 simultaneously causes a change in the direction of the air flow sucked in by the suction device via the pipe 14 and heightwise adjustment of the rotating brush 8.

In order to modify the bearing pressure exerted by the rotating brush 8 on the surface to be cleaned, said pressure being determined by the tractional force of the drive belt 17, loading or lightening devices which exert their action on the levers 26 may be used.

Figure 9:
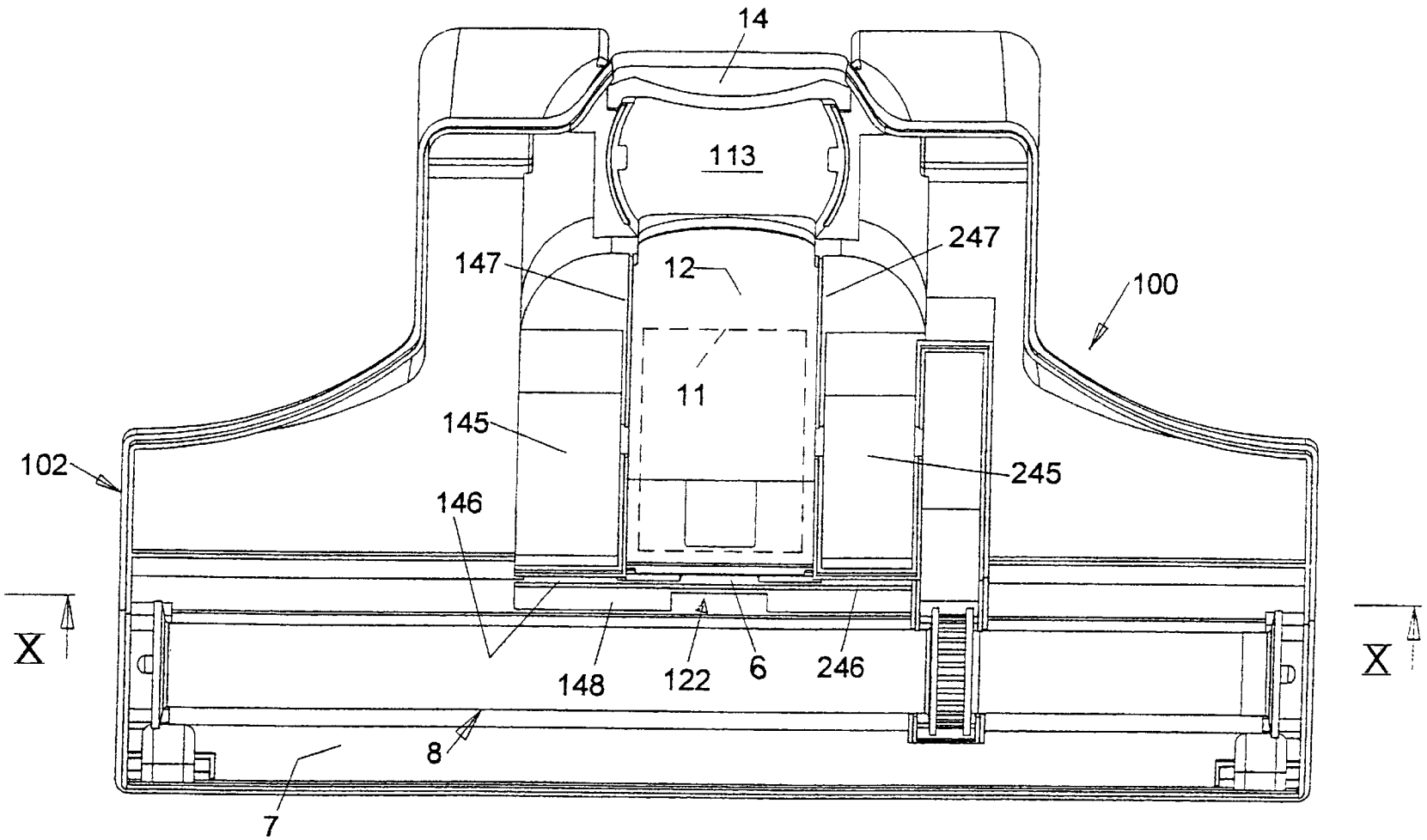
FIG. 9 shows a top view of a variant of the device for removing dust and rubbish of FIG. 1, wherein an upper part of a casing has been removed.
Figure 10:
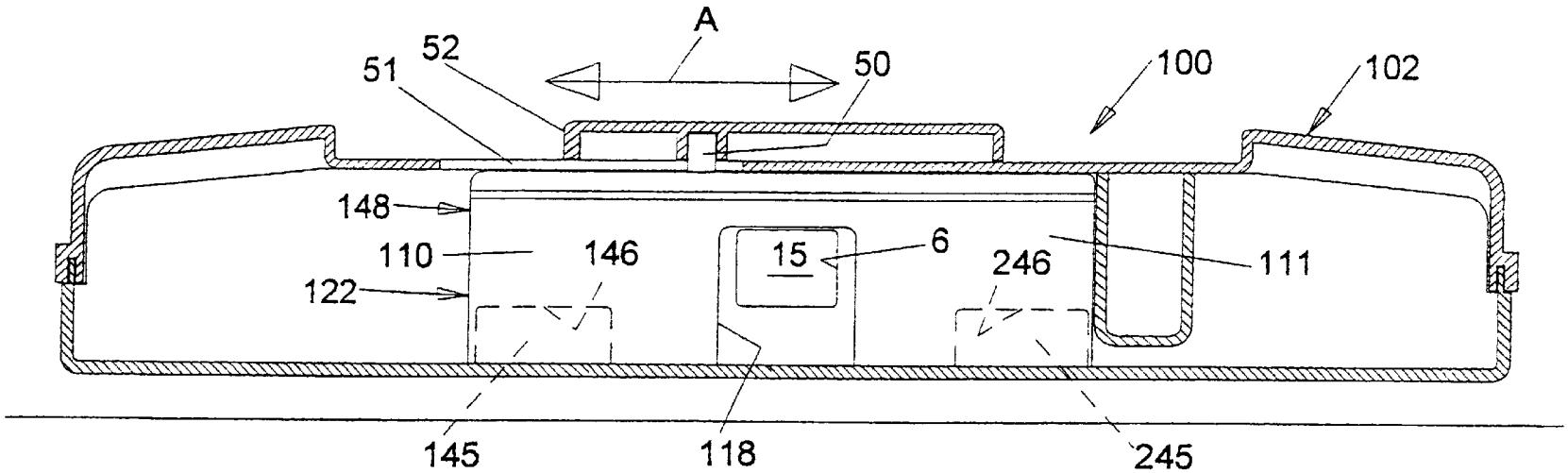
FIG. 10 shows a cross-sectional view along the plane X—X of FIG. 9.

FIGS. 9 and 10 show a device 100 for removing dust and rubbish where the parts as those of the device 1 are denoted by the same reference numerals.

The device 100 has a casing 102 including the housing 7 of the rotating brush 8 and the housing 12 of turbine 11. It further includes two ducts 145 and 245 which bypass the housing 12 of the turbine 11 and are placed at the sides of the housing 12 of turbine 11. Both the bypass ducts 145 and 245 directly connect the housing 7 of the rotating brush 8 with a joint 113 and the suction pipe 14. The bypass ducts 145 and 245 have respective inlet ports 146 and 246 (FIG. 10) and respective outlet ports 147 and 247.

A slide valve 122 has a plate-like sliding shutter 148 engageable with the suction nozzle 15 and bypass ducts 145 and 245. The shutter 148 slides in a transverse direction (arrow A) and is connected to the slider 52 which is actuated manually by a person using the device 100. Optionally, the slider 52 may be actuated by a conventional motor.

The sliding shutter 148 has lateral portions 110 and 111 and an intermediate opening 118. The opening 118 is designed to be superimposed on the inlet port 6 of the suction nozzle 15 when the operator wants connect the housing 7 of the brush 8 to the suction nozzle 15. The lateral portion 111 of sliding shutter 148 is designed to be superimposed to the inlet ports 246 of the bypass duct 245 and to be removed from it for disconnecting and, respectively, connecting the housing 7 to the bypass duct 245. The lateral portion 110 is designed to be superimposed to the inlet ports 146 of the bypass duct 145 for disconnecting the housing 7 from the bypass duct 145. The opening 118 is also designed to be superimposed on the inlet port 146 of the bypass duct 145 for connecting the housing 7 of the brush 8 to the bypass duct 145. Preferably, the opening 118 is wider than the cross-section of the inlet port 6 and substantially equal to the width of the cross-section of the inlet port 146.

The device 100 operates as the device 1.

When the operator wants operate the device 100 as a turbo-brush head, he has to adjust the sliding shutter 148 of the slide valve 122 in a position where the opening 118 is superimposed on the inlet port 6 of the suction nozzle 15. In this position of the shutter 148, the suction nozzle 15 is completely open, while the inlet ports 146 and 246 of the bypass ducts 145 and 245 are closed by the lateral portions 110 and 111, respectively (FIG. 10).

The turbine 11 is active and drives the brush 8.

When the operator wants operate the device 100 as a suction head only, he has to displace the sliding shutter 148 of the slide valve 122 to the left-hand side of arrow A in FIG. 10 till the shutter 148 opens the inlet ports 146 and 246 of the bypass ducts 145 and 245, respectively, and closes the inlet port 6 of the suction nozzle 15. In this position of the shutter 148, the inlet port 246 is open thanks to the displacement of the lateral portion 111 on the left, while the inlet port 146 is open thanks to the concurrent displacement of the opening 118 on the inlet port 146.

The turbine 11 and the rotating brush 8 are thus deactivated and the air flow which removes the dust and rubbish from the surface to be cleaned is sucked via the opening 5, passes through the housing 7 and is directly conveyed by means of the bypass ducts 145 and 245 to the joint 113 and the suction pipe 14.

The displacement of the sliding shutter 148 in any intermediate positions allows to vary at will the flow cross-section of the inlet ports 6, 146 and 246 of the suction nozzle 15 and of the bypass ducts 145 and 245, respectively. It is thus possible to control the air flows which impact and/or bypass the turbine 11 and the housing 12.

The arrangement of the bypass ducts 145 and 245 at the sides of the housing 12 of the turbine 11 is preferred because it minimizes the height of the device 100 in comparison with that of the device 1.

What is claimed is:

1. A device for removing dust and rubbish from a surface, comprising:

a casing provided with a suction opening, a rotating brush, a turbine operationally connected to said brush, a suction nozzle having a predefined flow cross-section, a suction pipe connected to a suction device, said rotating brush having a shaft rotatably supported in a first housing of said casing, said turbine having a shaft rotatably supported in a second housing of said casing, said suction nozzle being located between said rotating brush and said turbine for directing an air flow from said suction opening onto said rotating brush and then onto said turbine, a first bypass duct having a predefined flow cross-section, which first bypass duct connects said suction opening and said suction pipe by bypassing said second housing and said turbine, a first valve which at least partially closes said suction nozzle and at least partially opens said bypass duct.

2. The device according to claim 1, wherein said first valve is configured so that actuation of said first valve varies the flow cross-section of said suction nozzle.

3. The device according to claim 1, wherein said first valve is configured so that actuation of said first valve varies the flow cross-section of said first bypass duct.

4. The device according to claim 1, wherein said first valve is configured so that actuation of said first valve progressively closes said flow cross-section of said suction nozzle while progressively opening said flow cross-section of said first bypass duct.

5. The device according to claim 1, wherein said first valve is connected to a manual actuating element.

6. The device according to claim 1, wherein said first valve comprises a first slide valve having a first sliding shutter provided with a first opening able to be superimposed on said flow cross-section of said suction nozzle.

7. The device according to claim 6, wherein said first sliding shutter is further provided with a second opening able to be superimposed on said flow cross-section of said first bypass duct.

8. The device according to claim 7, wherein said first opening of said first sliding shutter has a width greater than the width of said flow cross-section of said suction nozzle and wherein said second opening of said first sliding shutter has a width greater than a width of said flow cross-section of said first bypass duct.

9. The device according to claim 6, further comprising:

an auxiliary opening which connects said first housing to an external environment, and a second valve which opens said auxiliary opening when said turbine undergoes a drop in power owing to obstruction of said suction opening.

10. The device according to claim 9, wherein said second valve comprises a second slide valve having a second sliding shutter provided with an opening designed to be superimposed on said auxiliary opening.

11. The device according to claim 10, wherein said first and second sliding shutters are operationally connected to a slider actuator.

12. The device according to claim 6, wherein said first opening of said first sliding shutter is able to be superimposed on the said flow cross-section of said suction nozzle and/or on said flow cross-section of said first bypass duct.

13. The device according to claim 12, wherein said first opening of said first sliding shutter has a width greater than a width of said flow cross-section of said suction nozzle and substantially equal to a width of said flow cross-section of said first bypass duct.

14. The device according to claim 6, wherein the first sliding shutter is slidable fundamentally parallel to the surface to be cleaned.

15. The device according to claim 1, wherein said shaft of said rotating brush is also movably supported in said first housing and is operationally connected to a shaft actuator which is capable of raising the shaft and keeping the shaft raised so as to move said rotating brush away from said surface to be cleaned.

16. The device according to claim 15, wherein said shaft actuator includes two levers which rotatably support said shaft of said rotating brush, said two levers being pivotably mounted in said first housing.

17. The device according to claim 16, wherein said shaft actuator includes a projecting element integral with said levers, and wherein said first valve comprises a first slide valve having a first sliding shutter provided with a first opening able to be superimposed on said flow cross-section of said suction nozzle, said first sliding shutter being provided with a ramp and a surface which engage with said projecting element for raising said projecting element and causing said projecting element to rotate integrally with said levers for raising said rotating brush and keeping said rotating brush raised.

18. The device according to claim 1, wherein said first bypass duct is placed under said second housing.

19. The device according to claim 1, further comprising a second bypass duct having a predefined cross-section and wherein the first bypass duct and the second bypass duct are placed at sides of said second housing.

20. The device according to claim 19, wherein said first valve comprises a first slide valve having a first sliding shutter provided with a first opening able to be superimposed on said flow cross-section of said suction nozzle and wherein said first sliding shutter is provided with a lateral portion able to be superimposed on said flow cross-section of said second bypass duct, while said first opening is able to be superimposed on said flow cross-section of said suction nozzle and/or on said flow cross-section of said first bypass duct.

21. A device for removing dust and rubbish from a surface, comprising:

a casing provided with a suction opening, a rotating brush, a turbine operationally connected to said brush, a suction nozzle having a predefined flow cross-section, a suction pipe connected to a suction device, casing, said turbine having a shaft rotatably supported in a second housing of said casing, said suction nozzle being located between said rotating brush and said turbine for directing an air flow from said suction opening onto said rotating brush and then onto said turbine, a first bypass duct having a predefined cross-section, which first bypass duct connects said suction opening and said suction pipe by bypassing said second housing and said turbine, a first valve which at least partially closes said suction nozzle and at least partially opens said bypass duct, wherein said first valve is connected to a manual actuating element, and wherein said first valve comprises a first slide valve having a first sliding shutter provided with a first opening able to be superimposed on said flow cross-section of said suction nozzle, the first sliding shutter being slidable fundamentally parallel to the surface.

* * * * *